US010967382B2

(12) United States Patent
Nariai et al.

(10) Patent No.: US 10,967,382 B2
(45) Date of Patent: Apr. 6, 2021

(54) VERTICAL ROLLER MILL

(71) Applicant: IHI Corporation, Koto-ku (JP)

(72) Inventors: Kentaro Nariai, Tokyo (JP); Emi Ohno, Tokyo (JP); Kazuhiro Watanabe, Tokyo (JP); Takahiro Kozaki, Tokyo (JP); Akira Kobayashi, Tokyo (JP)

(73) Assignee: IHI Corporation, Koto-ku (JP)

( * ) Notice: Subject to any disclaimer, the term of this patent is extended or adjusted under 35 U.S.C. 154(b) by 134 days.

(21) Appl. No.: 16/250,397

(22) Filed: Jan. 17, 2019

(65) Prior Publication Data

US 2019/0143338 A1 May 16, 2019

Related U.S. Application Data

(63) Continuation of application No. PCT/JP2017/023168, filed on Jun. 23, 2017.

(30) Foreign Application Priority Data

Jul. 21, 2016 (JP) ..... JP2016-143225
Jan. 31, 2017 (WO) ..... PCT/JP2017/003350

(51) Int. Cl.
*B02C 15/04* (2006.01)
*B07B 9/00* (2006.01)
(Continued)

(52) U.S. Cl.
CPC ..... *B02C 15/04* (2013.01); *B02C 15/001* (2013.01); *B02C 15/003* (2013.01);
(Continued)

(58) Field of Classification Search
CPC ..... B02C 15/001; B02C 15/04; B02C 15/007; B02C 2015/002; B07B 9/00; B07B 11/02; B07B 11/06; B07B 11/04
See application file for complete search history.

(56) References Cited

U.S. PATENT DOCUMENTS 4,240,586 A * 12/1980 Evans ..... B02C 15/00 241/103
4,597,537 A * 7/1986 Misaka ..... B02C 15/04 241/119
(Continued)

FOREIGN PATENT DOCUMENTS

CN 1547509 A 11/2004
CN 101918140 A 12/2010
(Continued)

*Primary Examiner* — Faye Francis
(74) *Attorney, Agent, or Firm* — Oblon, McClelland, Maier & Neustadt, L.L.P.

(57) ABSTRACT

A vertical roller mill includes a housing, a chute that supplies materials to be grinded to a center portion of the housing, a grinder that is provided below the chute and grinds the materials to be grinded, an exhaust pipe that is provided above the grinder, a transport mechanism that forms an air flow for transporting, to the exhaust pipe, grinded materials grinded by the grinder, and a flow-constricting flow path provided between the grinder and the exhaust pipe and narrows a flow path area for the air flow, in which the flow-constricting flow path is formed between a first flow-constricting ring provided in the center portion of the housing and a second flow-constricting ring provided to protrude from the housing toward the center portion of the housing.

7 Claims, 8 Drawing Sheets

(51) Int. Cl.

| | |
|---|---|
| ***B07B 11/02*** | (2006.01) |
| ***B07B 11/06*** | (2006.01) |
| ***B07B 11/04*** | (2006.01) |
| ***B07B 7/083*** | (2006.01) |
| ***B07B 7/01*** | (2006.01) |
| ***B02C 15/00*** | (2006.01) |

(52) U.S. Cl.
CPC ..... *B02C 15/007* (2013.01); *B07B 7/01* (2013.01); *B07B 7/083* (2013.01); *B07B 9/00* (2013.01); *B07B 11/02* (2013.01); *B07B 11/04* (2013.01); *B07B 11/06* (2013.01); *B02C 2015/002* (2013.01)

(56) References Cited

U.S. PATENT DOCUMENTS

| | | | | |
|---|---|---|---|---|
| 4,598,872 | A * | 7/1986 | Henne | B02C 15/001 241/119 |
| 4,927,086 | A * | 5/1990 | Henne | B02C 15/001 241/119 |
| 5,180,113 | A * | 1/1993 | Gehrke | B02C 23/32 209/139.1 |
| 7,350,727 | B2 | 4/2008 | Kronz | |
| 8,113,452 | B2 | 2/2012 | Folsberg et al. | |
| 8,220,123 | B2 * | 7/2012 | Wark | F23K 1/00 29/401.1 |
| 2004/0182955 | A1 | 9/2004 | Kronz | |
| 2006/0049288 | A1 | 3/2006 | Kronz | |
| 2006/0255195 | A1 | 11/2006 | Chen et al. | |
| 2008/0054112 | A1 * | 3/2008 | Farris | B02C 15/001 241/121 |
| 2010/0258661 | A1 | 10/2010 | Folsberg et al. | |
| 2013/0061787 | A1 * | 3/2013 | Iida | C10L 5/366 110/232 |

FOREIGN PATENT DOCUMENTS

| | | | |
|---|---|---|---|
| CN | 102847586 | A | 1/2013 |
| CN | 102847587 | A | 1/2013 |
| CN | 203196692 | U | 9/2013 |
| CN | 103341445 | A | 10/2013 |
| CN | 204953090 | U | 1/2016 |
| EP | 0 172 731 | B1 | 10/1990 |
| JP | 10-180126 | | 7/1998 |
| JP | 2011-251222 | | 12/2011 |
| JP | 2012-24652 | | 2/2012 |
| JP | 2012-51156 | | 3/2012 |
| JP | 2012-83016 | A | 4/2012 |
| JP | 2012-217920 | | 11/2012 |
| JP | 2013-158667 | | 8/2013 |
| JP | 2013-180239 | | 9/2013 |
| JP | 2013-184115 | | 9/2013 |
| JP | 5581714 | | 9/2014 |
| JP | 2016-83638 | A | 5/2016 |
| JP | 2016-87544 | | 5/2016 |

* cited by examiner

VERTICAL ROLLER MILL

CROSS-REFERENCE TO RELATED APPLICATIONS

This application is a Continuation Application based on International Application No. PCT/JP 2017/023168, filed Jun. 23, 2017, which claims priority on Japanese Patent Application No. 2016-143225, filed Jul. 21, 2016, and PCT International Application No. PCT/JP 2017/003350, filed Jan. 31, 2017, the contents of which are incorporated herein by reference.

TECHNICAL FIELD

The present disclosure relates to a vertical roller mill.

BACKGROUND

For example, a biomass mill disclosed in Patent Document 1 is known as a vertical roller mill. Fuel for boilers has mainly been coal, but recently woody biomass, which is renewable and has a lower environmental impact, has been investigated as fuel in order to reduce carbon dioxide. To use woody biomass as fuel for boilers, there is a need to grind woody biomass, which is hardened into a pellet shape, to a size at which the woody biomass can be burned by a burner.

The biomass mill disclosed in Patent Document 1 is based on a coal roller mill for grinding coal, and is configured to grind woody biomass at low cost without great remodeling or a great change in equipment thereof. In the case where woody biomass is grinded, since the woody biomass is lighter than coal and is fibrous in which fibers are intertwined mutually, the woody biomass is raised while swirling inside the housing, and therefore the woody biomass tends to remain in a housing.

For this reason, in the biomass mill disclosed in Patent Document 1, a flow-constricting cone that has a circular head portion is provided around a chute that is configured to supply the woody biomass, to form, between the circular head portion and a housing, a flow-constricting flow path that reduces a flow path area for an air flow that is ejected from the outer peripheral of a grinding table, and thereby the velocity of the air flow is increased to improve the exhausting performance of the woody biomass.

The vertical roller mill is also disclosed in Patent Documents 2 to 5.

Patent Document 1: Japanese Unexamined Patent Application, First Publication No. 2013-184115

Patent Document 2: Japanese Unexamined Patent Application, First Publication No. 2011-251222

Patent Document 3: Japanese Unexamined Patent Application, First Publication No. 2016-087544

Patent Document 4: Japanese Unexamined Patent Application, First Publication No. H10-180126

Patent Document 5: Japanese Unexamined Patent Application, First Publication No. 2013-158667

SUMMARY

A structure that controls the flow velocity in the flow-constricting flow path to a predetermined flow velocity, and thereby allows the woody biomass to adequately pass through the flow-constricting flow path has been proposed through numerous experiments. However, when a dimension of the gap in the flow-constricting flow path is small, a phenomenon in which ungrinded materials pass through the flow-constricting flow path has been confirmed even when the flow velocity is lower than the predetermined flow velocity.

The present disclosure was made in view of the above circumstances, and it is an object thereof to provide a vertical roller mill capable of preventing ungrinded materials from passing through a flow-constricting flow path at a prescribed flow velocity at which woody biomass can adequately pass through the flow-constricting flow path.

A vertical roller mill according to an aspect of the present disclosure includes: a housing; a chute that supplies materials to be grinded to a center portion of the housing; a grinder that is provided below the chute and grinds the materials to be grinded; an exhaust pipe that is provided above the grinder; a transport mechanism that forms an air flow for transporting, to the exhaust pipe, grinded materials obtained by grinding the materials to be grinded by the grinder; and a flow-constricting flow path provided between the grinder and the exhaust pipe and narrows a flow path area for the air flow, in which the flow-constricting flow path is formed between a first flow-constricting ring provided in the center portion of the housing and a second flow-constricting ring provided to protrude from the housing toward the center portion of the housing.

According to the present disclosure, the flow-constricting flow path is formed between the first flow-constricting ring that is provided in the center portion of the housing and the second flow-constricting ring that is provided to protrude from the housing toward the center portion of the housing. That is, the flow-constricting flow path is formed in a region inside the housing, in a ring shape. The flow velocity of the air flow in the flow-constricting flow path depends on a size of the flow path area of the flow-constricting flow path. In a case where a flow-constricting flow path having a prescribed flow path area is formed along the housing as in the related art, the radius of the flow-constricting flow path is increased, and a dimension of a gap in the flow-constricting flow path is reduced, so that a phenomenon of ungrinded materials passing through the flow-constricting flow path readily occurs. On the other hand, in the case where the flow-constricting flow path having a prescribed flow path area is formed in a region inside the housing as in the present disclosure, the radius of the flow-constricting flow path is reduced, and the dimension of the gap in the flow-constricting flow path can be greatly secured. Thus, the phenomenon of ungrinded materials passing through the flow-constricting flow path can be inhibited.

Therefore, according to the present disclosure, it is possible to prevent ungrinded materials from passing through the flow-constricting flow path at a predetermined flow velocity.

DESCRIPTION OF EMBODIMENTS

Hereinafter, an embodiment of the present disclosure will be described with reference to the drawings.

Figure 1:
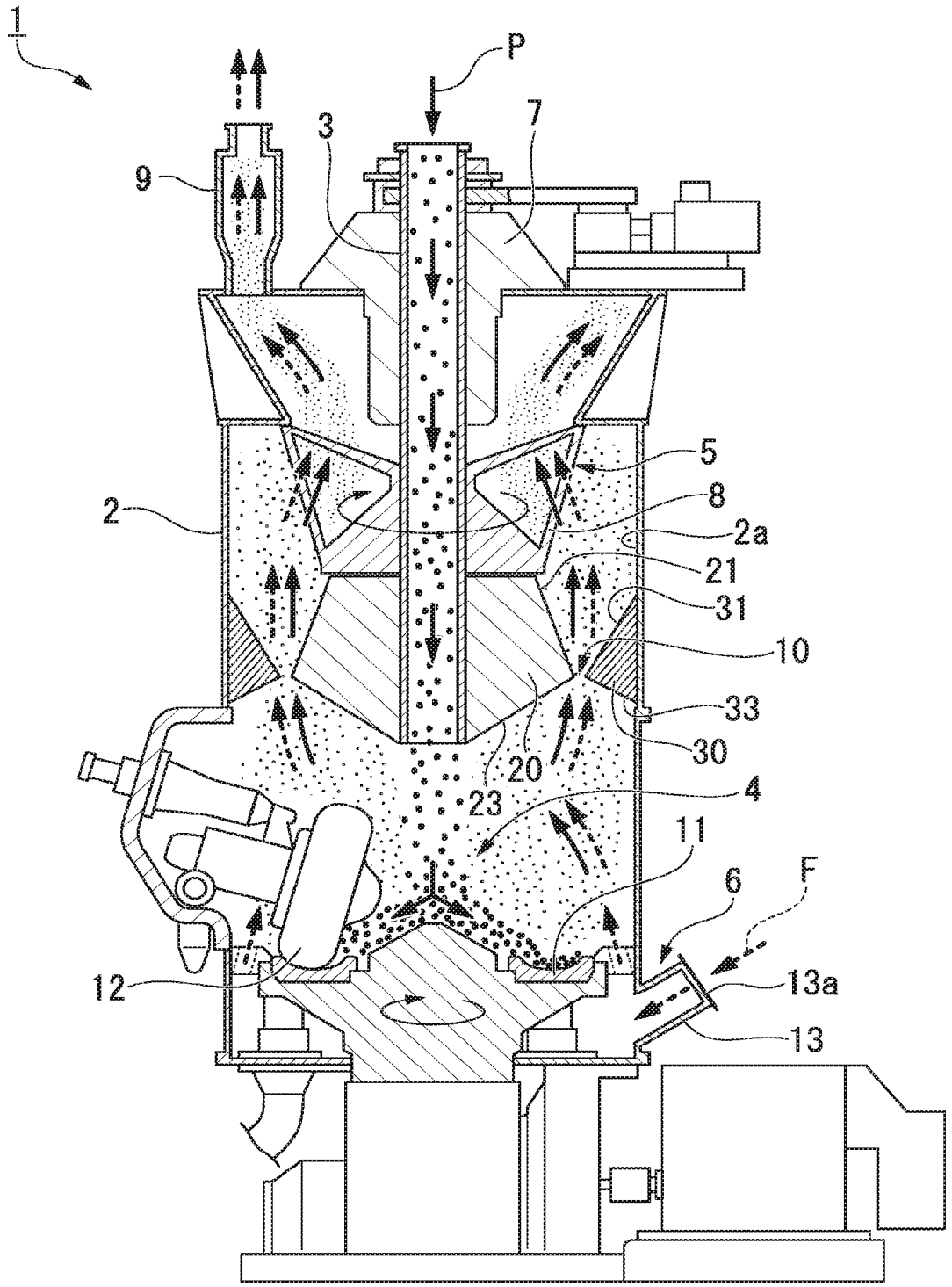
FIG. 1 is a schematic constitutional view of a vertical roller mill in an embodiment of the present disclosure.
Figure 2:
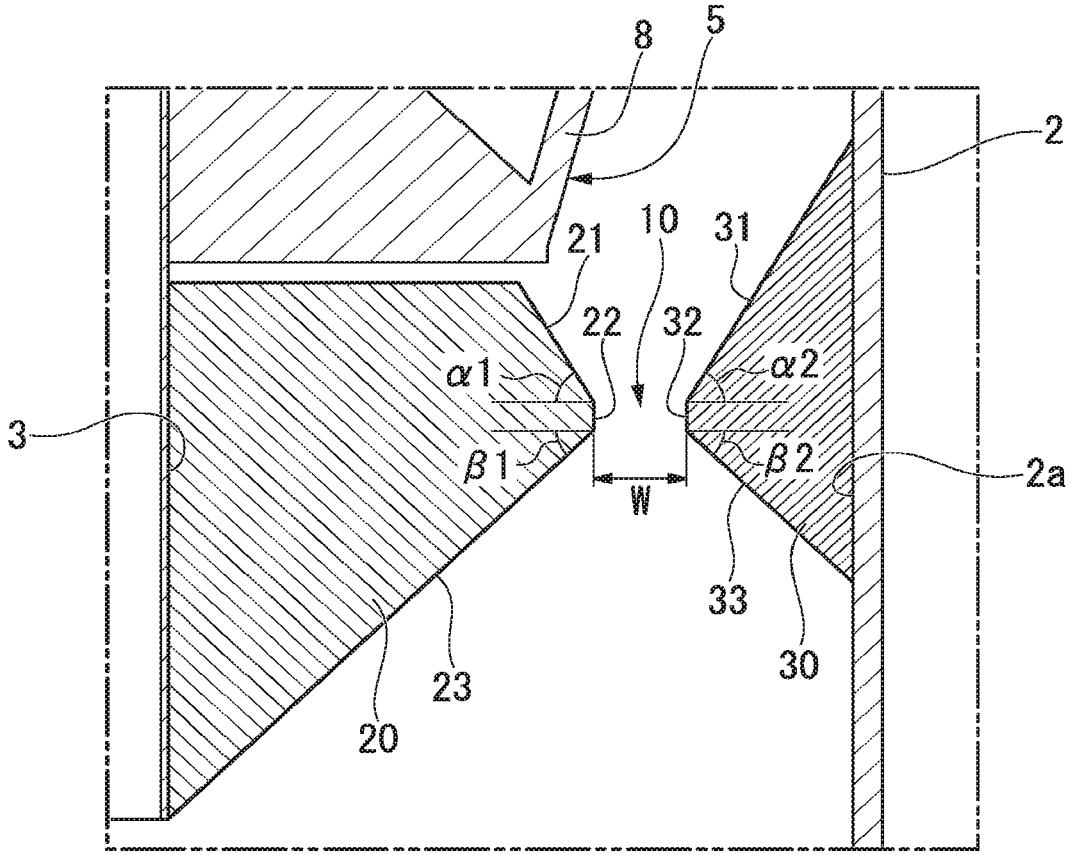
FIG. 2 is an enlarged view of main parts of the vertical roller mill in the embodiment of the present disclosure.

FIG. 1 is a schematic constitutional view of a vertical roller mill 1 in an embodiment of the present disclosure. FIG. 2 is an enlarged view of main parts of the vertical roller mill 1 in the embodiment of the present disclosure.

The vertical roller mill 1 of the present embodiment grinds woody biomass (materials to be grinded) hardened in a pellet shape, and discharges it together with an air flow. An arrow indicated in FIG. 1 by a reference sign P denotes a flow of the pellets (the materials to be grinded), and an arrow indicated by a reference sign F denotes an air flow.

As shown in FIG. 1, the vertical roller mill 1 includes a housing 2, a chute 3 that supplies the materials to be grinded to a center portion of the housing 2, a grinder 4 that is provided inside the housing 2, an exhaust pipe 9 that is provided above the grinder 4, a transport mechanism 6 that transports grinded materials to the exhaust pipe 9 using the air flow, and first and second flow-constricting rings 20 and 30 (to be described below).

The housing 2 has an approximately cylindrical shape erected in a vertical direction, and has a lid 7 that covers an upper opening of the housing 2. The chute 3 having a cylindrical shape is inserted into a center portion of the lid 7. The chute 3 is disposed in the vertical direction. An upper opening of the chute 3 is disposed outside the lid 7, and a lower opening of the chute 3 is disposed below a rotary classifier 5 inside the housing 2. A pellet supply device (not shown) is connected to the upper opening of the chute 3, and thereby a predetermined amount of the woody biomass pellets (the materials to be grinded) is supplied to the housing 2.

The rotary classifier 5 is attached to a rear surface side of the lid 7. A number of rotary classification blades 8 are arranged on a rotary rotor (not shown) provided in the center portion of the lid 7, at regular intervals in a circumferential direction of the rotary rotor. The rotary classifier 5 rotates the rotary classification blades 8 at a prescribed rotational speed by rotating the rotary rotor using a driving device (not shown).

The grinder 4 includes a rotary table 11 that is provided on a bottom portion of the housing 2, and a plurality of grinding rollers 12 that are rolled on the rotary table 11.

The rotary table 11 is rotated on a horizontal plane at a low speed.

The grinding rollers 12 are brought into pressure contact with the rotary table 11 by a roller pressurizing device. In this state, the rotary table 11 is rotated, and thereby the grinding rollers 12 are rolled on the rotary table 11.

The grinder 4 having this constitution moves pellets (materials to be grinded), which are supplied from the chute 3 to a center portion of the rotary table 11, on the rotary table 11, to an outer circumferential side of the rotary table 11 by a centrifugal force acting on the pellets (materials to be grinded), jams the pellets (materials to be grinded) between an upper surface of the rotary table 11 and the grinding rollers 12, and grinds the pellets (materials to be grinded) by means of a compressive force and a shear force.

The transport mechanism 6 includes an air introduction part 13 provided at the bottom portion of a side surface of the housing 2 and air introduction means (not shown) for introducing outside air from an introduction port 13*a* of the air introduction part 13. In the transport mechanism 6, the air is guided to an outer periphery portion of the rotary table 11 using the air introduction means, and then is raised inside the housing 2 to flow into the exhaust pipe 9. The transport mechanism 6 generates an air flow from the bottom portion of the housing 2, that is, from the rotary table 11, toward an upper portion of the housing 2, that is, toward the exhaust pipe 9, and the grinded material is transported to the exhaust pipe 9 by being carried (entrained) in this air flow.

This vertical roller mill 1 has a flow-constricting flow path 10 that is provided between the grinder 4 and the exhaust pipe 9 and narrows a flow path area for the air flow. The flow-constricting flow path 10 accelerates the flow velocity of the air flow to improve exhausting performance of big grinded materials (woody biomass) that tends to remain in the housing 2. The flow-constricting flow path 10 is formed between the first flow-constricting ring 20 that is provided in the center portion of the housing 2 and the second flow-constricting ring 30 that is provided to protrude from the housing 2 toward the center portion of the housing 2.

The first flow-constricting ring 20 is provided around the chute 3. The first flow-constricting ring 20 is provided in a region from a lower end of the rotary classifier 5 to a lower portion of the chute 3. The first flow-constricting ring 20 protrudes (bulges) outward from the chute 3 toward an inner wall 2*a* of the housing 2 in a radial direction of the housing 2.

The second flow-constricting ring 30 is provided on the inner wall 2*a* of the housing 2. The second flow-constricting ring 30 is provided at a height at which the second flow-constricting ring 30 can face the first flow-constricting ring 20 in the radial direction of the housing 2. The second flow-constricting ring 30 protrudes (bulges) inward from the inner wall 2*a* of the housing 2 toward the chute 3 in the radial direction of the housing 2.

As shown in FIG. 2, at least one of the first flow-constricting ring 20 and the second flow-constricting ring 30 (both of them in the present embodiment) has an inclined surface 21 or 31 that is formed at an upper portion thereof and is inclined downward to approach the other of them. That is, the inclined surface 21 is formed at the upper portion of the first flow-constricting ring 20 (one of them), and is inclined downward to approach the second flow-constricting ring 30 (the other of them). In addition, the inclined surface 31 is formed at the upper portion of the second flow-constricting ring 30 (one of them), and is inclined downward to approach the first flow-constricting ring 20 (the other of them).

The second flow-constricting ring 30 has an inner diameter that is larger than an outer diameter of the first flow-constricting ring 20. That is, the second flow-constricting ring 30 faces the first flow-constricting ring 20 with a gap W therebetween in the radial direction of the housing 2. The gap W becomes the flow-constricting flow path 10. In the following description, this gap W is also called a gap W of the flow-constricting flow path. In the present embodiment, the flow-constricting flow path 10 is formed in a region of the outer half of the radius of the housing 2. The inner diameter of the second flow-constricting ring 30 is smaller than the diameter of the inner wall 2*a* of the housing 2. That is, the flow-constricting flow path 10 is formed in a region inside the inner wall 2*a* of the housing 2.

The inclined surface 31 formed on the second flow-constricting ring 30 is inclined downward to approach the center portion of the housing 2 from the inner wall 2*a* of the housing 2. The inclined surfaces 21 and 31 are formed at angles α1 and α2 that are greater than or equal to the angle of repose of the grinded materials. In the present embodiment, each of the angles α1 and α2 is formed at an angle of 60°. The angles α1 and α2 may be angles that are different from each other as long as they are greater than or equal to the angle of repose of the grinded materials.

Facing surfaces 22 and 32 of the first flow-constricting ring 20 and the second flow-constricting ring 30 are formed to be flat. The facing surface 22 formed on the first flow-constricting ring 20 extends vertically downward from the lower end of the inclined surface 21 by a predetermined distance. The facing surface 32 formed on the second flow-constricting ring 30 extends vertically downward from a lower end of the inclined surface 31 by the predetermined distance. That is, the facing surfaces 22 and 32 are formed parallel to each other and have predetermined distances.

At least one of the first flow-constricting ring 20 and the second flow-constricting ring 30 (both of them in the present embodiment) has an inclined surface 23 or 33 that is formed at a lower portion thereof and is inclined downward to be separated from the other of them. That is, the inclined surface 23 is formed at the lower portion of the first flow-constricting ring 20 (one of them), and is inclined downward to be separated from the second flow-constricting ring 30 (the other of them). In addition, the inclined surface 33 is formed at the lower portion of the second flow-constricting ring 30 (one of them), and is inclined downward to be separated from the first flow-constricting ring 20 (the other of them).

The inclined surface 23 is formed from a lower end of the facing surface 22 to the lower portion of the chute 3. The inclined surface 33 is formed from a lower end of the facing surface 32 to the inner wall 2*a* of the housing 2. The inclined surfaces 23 and 33 are formed from the lower ends of the facing surfaces 22 and 32 at angles β1 and β2.

In the present embodiment, each of the angles β1 and β2 is formed at an angle of 45°. The angles β1 and β2 may be angles that are different from each other.

Figure 3:
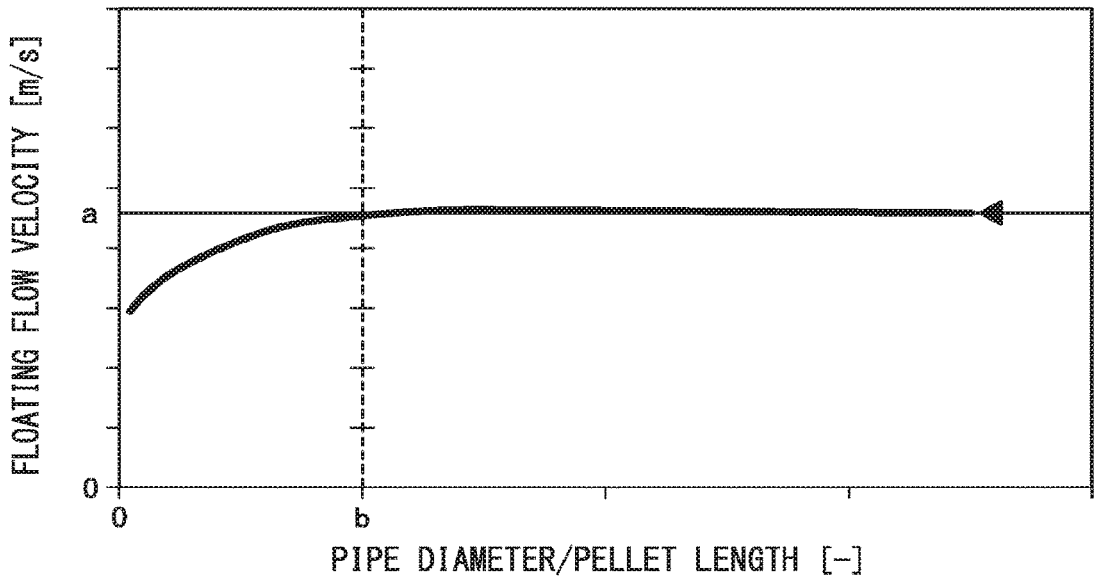
FIG. 3 is a graph showing a relationship between a floating flow velocity for pellets (grinded materials) and a pipe diameter/a pellet length.

FIG. 3 is a graph showing a relationship between a floating flow velocity for pellets (grinded materials) and a ratio of a pipe diameter to a pellet length. This graph shows the test results of a pellet floating airflow test in which a flow velocity at which ungrinded pellets float is evaluated while changing the pipe diameter and the pellet length.

A floating flow velocity a is a flow velocity at which the ungrinded pellets can pass through the flow-constricting flow path 10. That is, when the flow velocity is set to be slower than or equal to the floating flow velocity a, the pellets can be prevented from remaining at the upper portions of the first and second flow-constricting rings 20 and 30 as, for example, the pellets are returned to the grinder 4 without passing through the flow-constricting flow path 10.

As shown in FIG. 3, when the ratio of the pipe diameter to the pellet length is greater than or equal to a prescribed value b, the floating flow velocity becomes a nearly constant floating flow velocity a (a target value). On the other hand, when the ratio of the pipe diameter to the pellet length is smaller than the prescribed value b, it is found that the ungrinded pellets float even if the floating flow velocity is slower than the floating flow velocity a. This is because a phenomenon of the ungrinded materials passing through the flow-constricting flow path 10 in which the ungrinded pellets pass through the flow-constricting flow path 10 occurs when lengths of the pellets approach the pipe diameter, that is, a dimension of the gap W between the first flow-constricting ring 20 and the second flow-constricting ring 30 shown in FIG. 2.

As shown in FIG. 1, the vertical roller mill 1 of the present embodiment has the flow-constricting flow path 10 formed between the first flow-constricting ring 20 that is provided in the center portion of the housing 2 and the second flow-constricting ring 30 that is provided to protrude from the housing 2 toward the center portion of the housing. That is, the flow-constricting flow path 10 is formed in a region inside the housing 2, in a ring shape. The flow velocity of the air flow in the flow-constricting flow path 10 depends on the size of the flow path area of the flow-constricting flow path 10. In a case where the flow-constricting flow path 10 having a prescribed flow path area is formed along the inner wall 2*a* of the housing 2 as in Patent Document 1, the radius of the flow-constricting flow path 10 is increased, and a dimension of the gap W of the flow-constricting flow path 10 is reduced, so that the phenomenon of the ungrinded materials passing through the flow-constricting flow path 10 readily occurs. On the other hand, in the case where the flow-constricting flow path 10 having a prescribed flow path area is formed in a region inside the housing 2 as in the present embodiment, the radius of the flow-constricting flow path 10 is reduced, and the dimension of the gap W of the flow-constricting flow path 10 can be greatly secured. That is, the ratio of the pipe diameter (the gap W) to the pellet length is easily designed to be greater than or equal to the prescribed value b. As a result, the phenomenon of the ungrinded materials passing through the flow-constricting flow path 10 can be inhibited.

The grinded materials grinded in the grinder 4 get on the air flow generated by the transport mechanism 6, and are carried from the top of the rotary table 11 of the grinder 4 to the upper portion of the housing 2. When the air flow passes through the outer periphery portion of the rotary table 11, a turning component is added to the air flow, and the air flow flows along the inner wall 2*a* of the housing 2 due to a centrifugal force acting on the turning air flow, and thereby rises in the vicinity of the inner wall 2*a*. When the air flow rises along the inner wall 2*a* of the housing 2 to some extent, the air flow is guided to the flow-constricting flow path 10 by the inclined surfaces 23 and 33 of the lower portions of the first and second flow-constricting rings 20 and 30. For this reason, the flow velocity of the air flow is accelerated without increasing power of the transport mechanism 6, and the exhausting performance of the woody biomass can be enhanced.

In the present embodiment, as shown in FIG. 2, the inclined surfaces 21 and 31 are formed at the upper portions of the first and second flow-constricting rings 20 and 30. According to this constitution, some grinded materials, among the grinded materials that pass through the flow-constricting flow path 10, which deviate from the air flow can be prevented from being accumulated at the upper portions of the first and second flow-constricting rings 20 and 30. Furthermore, in the present embodiment, by forming the inclined surfaces 21 and 31 at the angles α1 and α2 which are greater than or equal to the angle of repose of the grinded material, it is possible to more reliably prevent the accumulation of grinded material at the upper portions of the first flow-constricting ring 20 and the second flow-constricting ring 30.

In the present embodiment, as shown in FIG. 2, the facing surfaces 22 and 32 of the first and second flow-constricting rings 20 and 30 are formed to be flat. Since the first flow-constricting ring 20 and the second flow-constricting ring 30 are separate members and are mounted on different structures (the chute 3 and the housing 2), an error tends to occur between mounting heights of the first and second flow-constricting rings 20 and 30. However, by forming the facing surfaces 22 and 32 of the first flow-constricting ring 20 and the second flow-constricting ring 30 to be flat, it is possible to allow a slight error in mounting height and to appropriately form the flow-constricting flow path 10 with a constant width.

In this way, the present embodiment described above discloses the vertical roller mill 1 which has the housing 2, the chute 3 that supplies the materials to be grinded to the center portion of the housing 2, the grinder 4 that is provided below the chute 3 and grinds the materials to be grinded, the exhaust pipe 9 that is provided above the grinder 4, and the transport mechanism 6 that forms air flow for transporting the grinded materials grinded by the grinder 4 to the exhaust pipe 9. The vertical roller mill 1 has the flow-constricting flow path 10 that is provided between the grinder 4 and the exhaust pipe 9 and narrows the flow path area for the air flow, and the flow-constricting flow path 10 is formed between the first flow-constricting ring 20 that is provided in the center portion of the housing 2 and the second flow-constricting ring 30 that is provided to protrude from the housing 2 toward the center portion of the housing 2. With this constitution, the flow velocity of the air flow passing through the flow-constricting flow path 10 becomes slower than or equal to the floating flow velocity a, and thereby the passage of the ungrinded pellets through the flow-constricting flow path 10 can be inhibited.

The present disclosure can adopt a modification as shown in FIGS. 4 to 7. In the following description, the same reference numerals are given to components the same as or equivalent to those in the above-described embodiment, and description thereof will be simplified or omitted.

Figure 4:
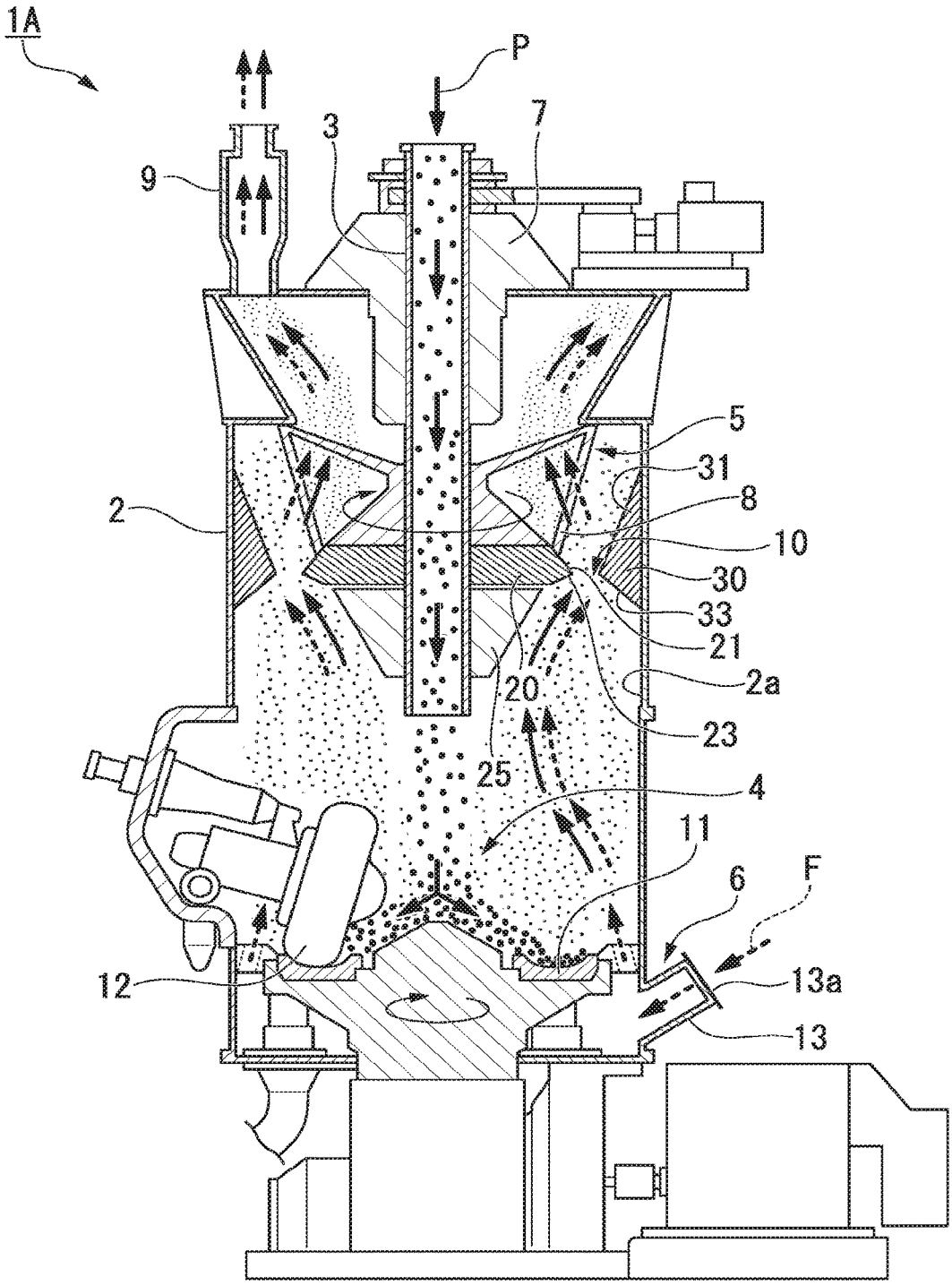
FIG. 4 is a schematic constitutional view of a vertical roller mill according to a modification of the embodiment of the present disclosure.

FIG. 4 is a schematic constitutional view of a vertical roller mill 1A according to a modification of the embodiment of the present disclosure.

In the vertical roller mill 1A, a guide 25 having an inverted conical shape is provided around a lower opening of a chute 3, and a first flow-constricting ring 20 disposed above the guide 25 is rotated along with a rotary classifier 5. That is, the first flow-constricting ring 20 is mounted on the rotary classifier 5. In this way, by providing the guide 25, the first flow-constricting ring 20 can be made lightweight.

Figure 5:
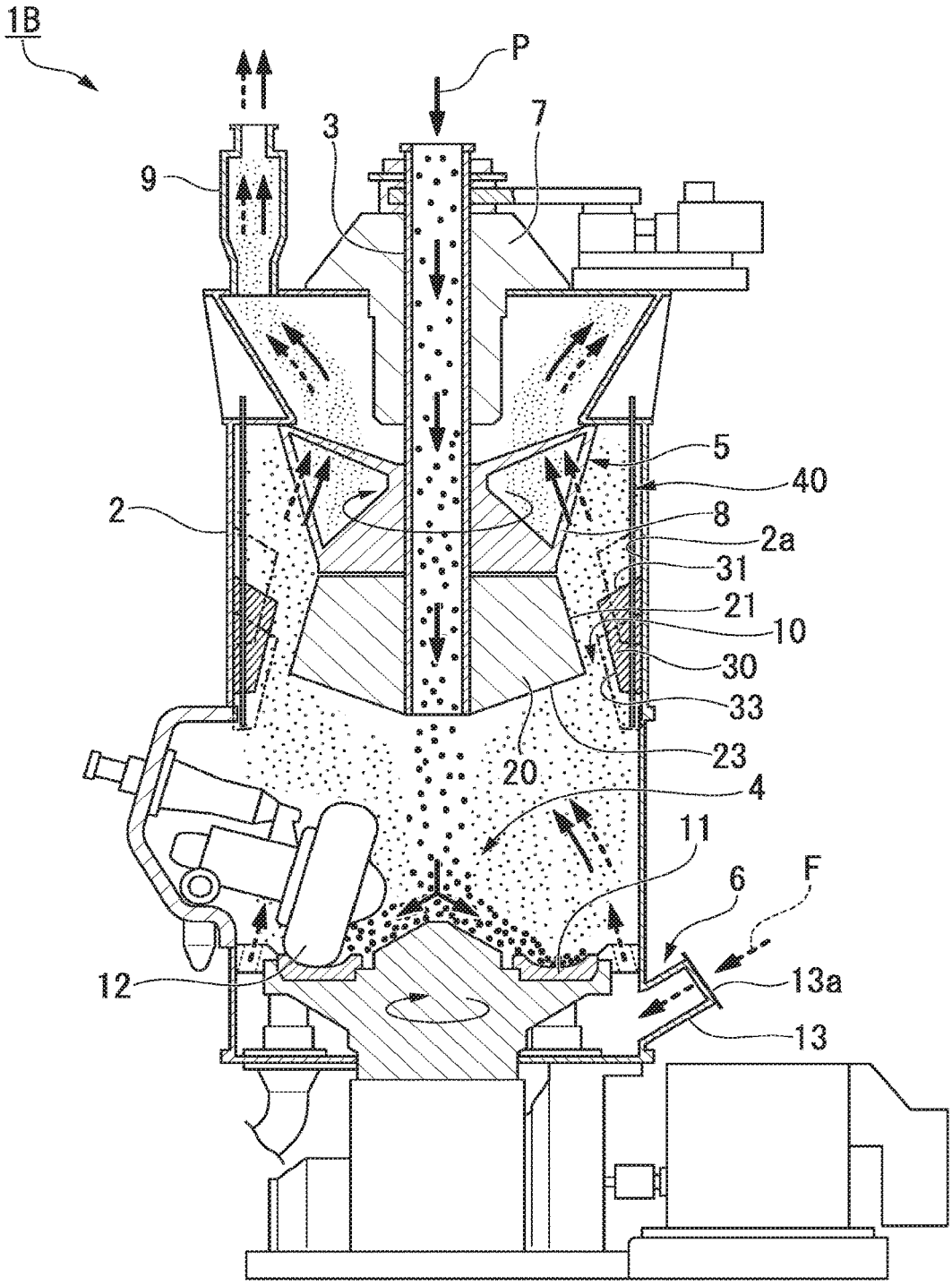
FIG. 5 is a schematic constitutional view of a vertical roller mill according to a modification of the embodiment of the present disclosure.

FIG. 5 is a schematic constitutional view of a vertical roller mill 1B according to a modification of the embodiment of the present disclosure.

The vertical roller mill 1B has an adjusting mechanism 40 that adjusts a dimension of a gap between a first flow-constricting ring 20 and a second flow-constricting ring 30. The adjusting mechanism 40 is a lifting mechanism, vertically moves the second flow-constricting ring 30, obliquely fits an inclined surface 33 of a lower portion of the second flow-constricting ring 30 to an inclined surface 21 of an upper portion of the first flow-constricting ring 20, and thereby adjusts the dimension of the gap between the first flow-constricting ring 20 and the second flow-constricting ring 30. According to this configuration, when the flow rate of the air flow is increased, the gap is enlarged by moving the second flow-constricting ring 30 up and down so that the gap flow velocity in the flow-constricting flow path 10 does not rise more than necessary. In addition, when the flow rate of the air flow is reduced, the gap can be narrowed by moving the second flow-constricting ring 30 up and down so that the gap flow velocity in the flow-constricting flow path 10 is not reduced more than necessary. When a type of pellets to be grinded is changed, it is thought that an optimal gap flow velocity is changed, but the gap flow velocity can be finely adjusted by the adjusting mechanism 40. Furthermore, the adjusting mechanism 40 may be controlled from the outside to be able to adjust a position of the second flow-constricting ring 30 according to a mill pressure difference during operation. When coal is grinded instead of woody biomass, the flow-constricting flow path 10 is not necessary. Thus, by raising the second flow-constricting ring 30 to a position at which it does not face the first flow-constricting ring 20 to reduce the gap flow velocity, switching between the grinding of the woody biomass and the grinding of the coal is also possible.

Figure 6:
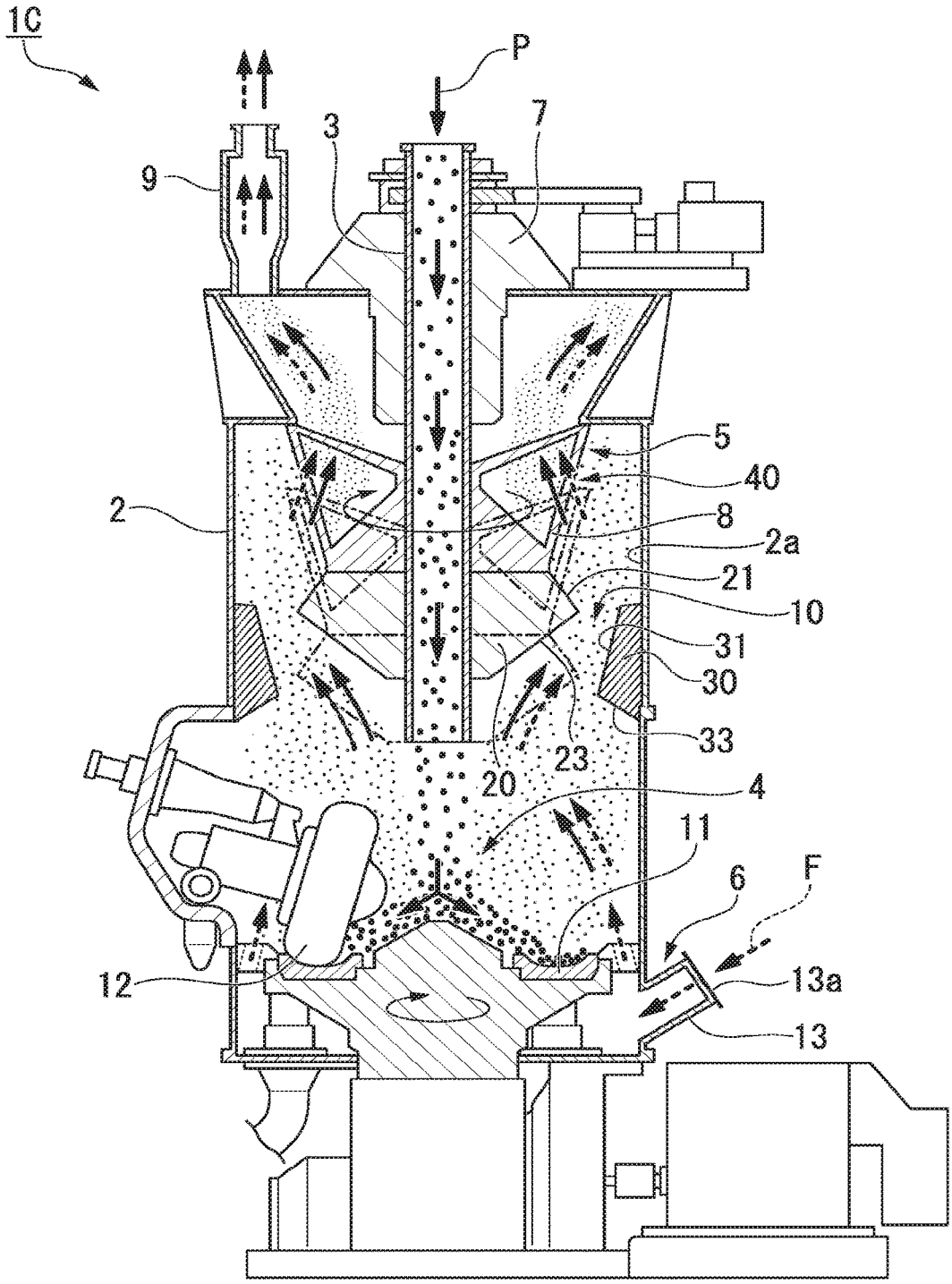
FIG. 6 is a schematic constitutional view of a vertical roller mill according to a modification of the embodiment of the present disclosure.

FIG. 6 is a schematic constitutional view of a vertical roller mill 1C according to a modification of the embodiment of the present disclosure.

An adjusting mechanism 40 of the vertical roller mill 1C vertically moves the first flow-constricting ring 20, and thereby adjusts a dimension of a gap between the first flow-constricting ring 20 and a second flow-constricting ring 30. The first flow-constricting ring 20 can be vertically moved along with a rotary classifier 5. That is, the rotary classifier 5 can be vertically moved along a chute 3, along with a bearing. According to this constitution, an operation is performed at a typical position (a high position indicated by a solid line in FIG. 6) when coal is grinded. When woody biomass is grinded, the rotary classifier 5 is lowered to be able to adjust a gap flow velocity as indicated by a double dotted-dashed line in FIG. 6 in the same way as the constitution shown in FIG. 5. For this reason, even when fuel is changed from coal to woody biomass or from the woody biomass to the coal, the fuel can be grinded without remodeling the mill, and a period of suspension of the mill when the fuel is changed can be reduced or removed. A position of the rotary classifier 5 may be manually adjusted from the inside of the mill, but may be changed from the outside by using a motor or the like such that fine adjustment of conditions during operation is possible.

Figure 7:
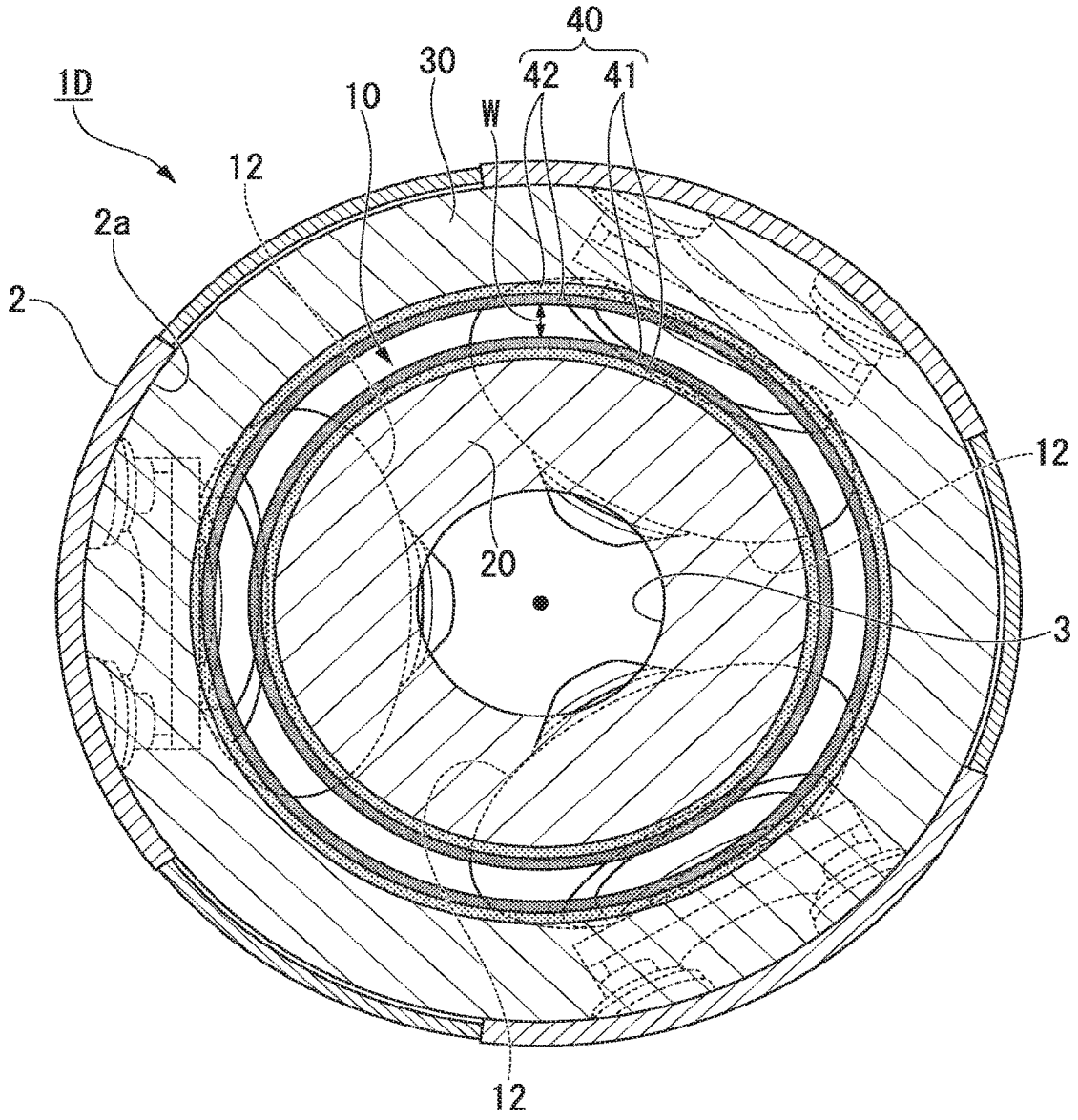
FIG. 7 is a plan sectional view of a vertical roller mill according to a modification of the embodiment of the present disclosure.

FIG. 7 is a plan sectional view of a vertical roller mill 1D according to a modification of the embodiment of the present disclosure.

An adjusting mechanism 40 of the vertical roller mill 1D is made up of a first plate member 41 that is mounted on an outer circumference of a first flow-constricting ring 20 in a layered form, and a second plate member 42 that is mounted on an inner circumference of a second flow-constricting ring 30 in a layered form. The first plate member 41 and the second plate member 42 are easily mounted on and demounted from the outer circumference of the first flow-constricting ring 20 and the inner circumference of the second flow-constricting ring 30 by an adhesive or spot welding. According to this constitution, a dimension of a gap W of a flow-constricting flow path 10 can be easily changed depending on operation conditions. Thereby, the operation conditions can be changed only by small-scale remodeling (mounting and demounting of a plate), and construction is completed in a short time. Since there is no need to make a plurality of flow-constricting rings according to the operation conditions, a total cost is reduced while an initial cost is slightly increased. Furthermore, since grinded materials pass through the outer circumference of the first flow-constricting ring 20 and the inner circumference of the second flow-constricting ring 30, there is concern over wear.

However, even when the wear occurs, repair or exchange is possible in a short period by demounting and exchanging only the plate.

Figure 8:
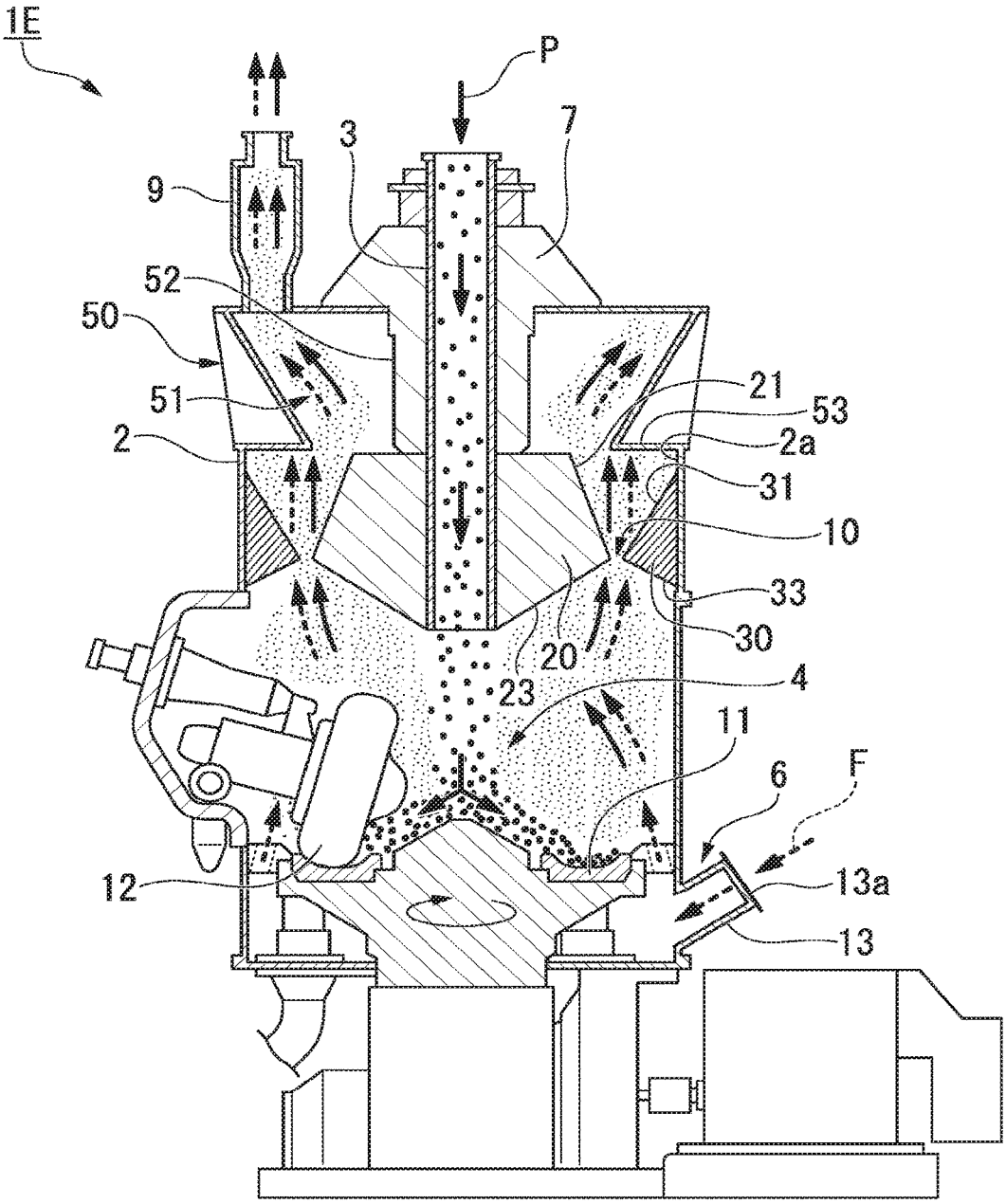
FIG. 8 is a schematic constitutional view of a vertical roller mill according to a modification of the embodiment of the present disclosure.

FIG. 8 is a schematic constitutional view of a vertical roller mill 1E according to a modification of the embodiment of the present disclosure.

A rotary classifier 5 is not provided on the vertical roller mill 1E. A distributor 50 to which an exhaust pipe 9 is connected is provided at an upper portion of a housing 2. The distributor 50 has a distribution space 51 with which the exhaust pipe 9 communicates, and a chute holder 52 that is vertically inserted through the center of the distribution space 51. The distribution space 51 is an annular space that is formed around the chute holder 52 in an inverted truncated cone shape, and the exhaust pipe 9 is connected to an upper surface of the distribution space 51. The chute holder 52 is a tubular portion that vertically extends downward from a lid 7, and is fixed to an outer circumferential surface of a chute 3.

A first flow-constricting ring 20 is provided on the distributor 50 having the above constitution. The first flow-constricting ring 20 is connected to a lower end of the chute holder 52. A second flow-constricting ring 30 may also be provided on the distributor 50. For example, the second flow-constricting ring 30 may be connected to a boundary wall 53 that is disposed at a boundary between the distribution space 51 of the distributor 50 which is shaped in an inverted truncated cone and a columnar internal space of the housing 2 that communicates with a lower portion of the distribution space 51. In the case where the second flow-constricting ring 30 is provided on the distributor 50 in this way, the first flow-constricting ring 20 may be disposed away from the distributor 50. Furthermore, the boundary wall 52 and the second flow-constricting ring 30 may be integrated such that the boundary wall 52 becomes the second flow-constricting ring 30, and the chute holder 52 and the first flow-constricting ring 20 may be integrated to cause the first flow-constricting ring 20 to protrude from an outer circumferential surface of the chute holder 52. That is, at least one of the first flow-constricting ring 20 and the second flow-constricting ring 30 is provided on the distributor 50.

It is known that woody biomass with a particle size of about 1 mm exhibits a combustibility comparable to that of coal (pulverized coal) of several tens of μm. For this reason, if the woody biomass can be discharged from the vertical roller mill 1E in a coarse state without being finely grinded, a grinding capacity of the vertical roller mill 1E can be increased. For this reason, when the woody biomass is grinded, the rotary classifier 5 may be stopped, or the rotary classifier 5 may be removed as in the vertical roller mill 1E. By removing the rotary classifier 5, at least one of the first flow-constricting ring 20 and the second flow-constricting ring 30 can be provided on the distributor 50. According to this configuration, the height of the vertical roller mill 1E can be reduced by an amount corresponding to that of the eliminated rotary classifier 5. If the height of the vertical roller mill 1E is reduced, for example a steel frame of an entire boiler building (not shown) that covers the vertical roller mill 1E can be reduced. In addition, by eliminating the rotary classifier 5, a motor, a rotor, and a bearing for driving the rotary classifier 5 also becomes unnecessary, such that it is possible to reduce the weight of the vertical roller mill 1E. Thereby, a total cost of a facility can be reduced.

While a preferred embodiment of the present disclosure and modifications thereof have been described with reference to the drawings, the present disclosure is not limited to the embodiment and its modifications. The forms and combinations of the constituent members shown in the above-described embodiment and its modifications are merely examples, and various modifications can be made based on design requirements or the like without departing from the gist of the present disclosure.

According to the vertical roller mill of the present disclosure, it is possible to prevent the ungrinded materials from passing through the flow-constricting flow path at a prescribed flow velocity at which the woody biomass can appropriately pass through the flow-constricting flow path.

What is claimed is:

1. A vertical roller mill comprising:

a housing;

a chute that supplies materials to be grinded to a center portion of the housing;

a grinder that is provided below the chute and grinds the materials to be grinded, the grinder including a table and a roller that is rolled on the table;

an exhaust pipe that is provided above the grinder;

a transport mechanism that forms an air flow for transporting, to the exhaust pipe, grinded materials obtained by grinding the materials to be grinded by the grinder;

a flow-constricting flow path provided between the grinder and the exhaust pipe and narrows a flow path area for the air flow, the flow-constricting flow path is formed between a first flow-constricting ring provided in the center portion of the housing and a second flow-constricting ring provided to protrude from the housing toward the center portion of the housing; and an adjusting mechanism configured to adjust a dimension of a gap between first flow-constricting ring and the second flow-constricting ring.

2. The vertical roller mill according to claim 1, wherein at least one of the first flow-constricting ring and the second flow-constricting ring has an inclined surface that is formed at an upper portion thereof and is inclined downward to approach the other of the first flow-constricting ring and the second flow-constricting ring.

3. The vertical roller mill according to claim 2, wherein the inclined surface is formed at an angle that is greater than or equal to an angle of repose of the grinded materials.

4. The vertical roller mill according to claim 1, wherein facing surfaces of the first and second flow-constricting rings are formed to be flat.

5. The vertical roller mill according to claim 1, wherein:

a rotary classifier is provided above the grinder; and the first flow-constricting ring is rotated along with the rotary classifier.

6. The vertical roller mill according to claim 4, wherein:

a rotary classifier is provided above the grinder; and the first flow-constricting ring is rotated along with the rotary classifier.

7. The vertical roller mill according to claim 1, wherein:

a distributor to which the exhaust pipe is connected is provided at an upper portion of the housing; and at least one of the first flow-constricting ring and the second flow-constricting ring is provided on the distributor.

* * * * *